US011355892B2

(12) United States Patent
Lin

(10) Patent No.: US 11,355,892 B2
(45) Date of Patent: Jun. 7, 2022

(54) CIRCULAR CONNECTOR

(71) Applicant: P-TWO INDUSTRIES INC., Taoyuan (TW)

(72) Inventor: Hsien-Chang Lin, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 17/137,322

(22) Filed: Dec. 29, 2020

(65) Prior Publication Data

US 2022/0131323 A1 Apr. 28, 2022

(30) Foreign Application Priority Data

Oct. 23, 2020 (TW) ..... 109137215

(51) Int. Cl.

| | |
|---|---|
| ***H01R 12/71*** | (2011.01) |
| ***H01R 24/50*** | (2011.01) |
| ***H01R 13/10*** | (2006.01) |
| ***H01R 13/04*** | (2006.01) |
| *H01R 103/00* | (2006.01) |

(52) U.S. Cl.

CPC ..... *H01R 24/50* (2013.01); *H01R 12/716* (2013.01); *H01R 13/04* (2013.01); *H01R 13/10* (2013.01); *H01R 2103/00* (2013.01)

(58) Field of Classification Search

CPC ..... H01R 24/50; H01R 12/716; H01R 13/04; H01R 13/10; H01R 2103/00

See application file for complete search history.

(56) References Cited

U.S. PATENT DOCUMENTS

| | | | | |
|---|---|---|---|---|
| 5,217,391 | A * | 6/1993 | Fisher, Jr. | H01R 24/44 439/578 |
| 5,316,486 | A * | 5/1994 | Tanaka | H01R 12/62 439/496 |
| 5,944,548 | A * | 8/1999 | Saito | H01R 24/52 439/248 |
| 6,273,748 | B1 * | 8/2001 | Komatsu | H01R 13/2442 439/496 |
| 6,776,668 | B1 * | 8/2004 | Scyoc | H01R 13/2421 439/295 |
| 6,796,811 | B1 * | 9/2004 | Pupkiewicz | H01R 13/2414 439/591 |
| 7,563,103 | B1 * | 7/2009 | Hall | H01R 24/50 439/581 |
| 7,648,394 | B2 * | 1/2010 | Yotsutani | H01R 12/718 439/581 |

(Continued)

*Primary Examiner* — Abdullah A Riyami
*Assistant Examiner* — Nelson R. Burgos-Guntin
(74) *Attorney, Agent, or Firm* — Fei-Hung Yang

(57) ABSTRACT

The present invention provides a circular connector, which comprises a male head and a female seat. The male head provides a first circular body, a third circular body, a first electrode group and a third electrode group. The female seat provides a first base, a second circular body, a fourth circular body, a second base, a second electrode group and a fourth electrode group. The second base, the fourth circular body, the second circular body and the first base are arranged outwards from the center point of the female seat. The male head is combined with the female base, so that the third circular body is inserted between the second circular body and the fourth circular body to realize non-directional electrical connection.

10 Claims, 11 Drawing Sheets

(56) References Cited

U.S. PATENT DOCUMENTS 8,944,827 B2 * 2/2015 Ohsaka ..... H01R 12/57 439/63
10,468,790 B2 * 11/2019 Imtiaz ..... H01R 9/05
10,760,640 B2 * 9/2020 Funke ..... F16F 9/3207
10,985,515 B2 * 4/2021 Tanaka ..... H01R 24/44
11,025,008 B2 * 6/2021 Kim ..... H01R 13/508
11,121,511 B1 * 9/2021 Long ..... H01R 13/6584
11,128,077 B1 * 9/2021 Lai ..... H01R 13/5219
2005/0164534 A1 * 7/2005 Li ..... H01L 23/49827 439/108
2006/0009075 A1 * 1/2006 Nagata ..... H01R 24/46 439/581
2006/0024985 A1 * 2/2006 Nagata ..... H01R 12/52 439/63
2011/0159708 A1 * 6/2011 Huang ..... H01R 24/46 439/63
2014/0030915 A1 * 1/2014 Perrin ..... H01R 24/50 439/578
2014/0235100 A1 * 8/2014 Perrin ..... H01R 9/0527 439/578
2014/0322970 A1 * 10/2014 Binder ..... H01R 24/44 439/578
2015/0270635 A1 * 9/2015 Wollitzer ..... H01R 13/2421 439/675
2015/0357735 A1 * 12/2015 Uratani ..... H01R 12/716 439/660
2018/0301834 A1 * 10/2018 Dandl ..... H01R 12/91
2019/0036240 A1 * 1/2019 Imtiaz ..... H01R 13/6277
2019/0123479 A1 * 4/2019 Lim ..... H01R 13/5202
2019/0237909 A1 * 8/2019 Young ..... H01R 13/6583
2019/0280439 A1 * 9/2019 Ni ..... H01R 13/2421
2020/0091639 A1 * 3/2020 Meynier ..... H01R 12/91
2020/0235488 A1 * 7/2020 Lin ..... H01R 12/716
2020/0235527 A1 * 7/2020 Eisfeld ..... H01R 13/405
2020/0251844 A1 * 8/2020 Wang ..... H01R 13/502
2020/0371167 A1 * 11/2020 Oosaka ..... H01R 31/06
2021/0083415 A1 * 3/2021 Huang ..... H01R 13/6315
2021/0143568 A1 * 5/2021 Zheng ..... H01R 24/50
2021/0143581 A1 * 5/2021 Wu ..... H01R 24/50
2021/0258412 A1 * 8/2021 Zuo ..... H04M 1/0235
2021/0376511 A1 * 12/2021 Kreklow ..... H05K 1/184
2021/0376543 A1 * 12/2021 Maejima ..... H01R 13/6583

* cited by examiner

Sectional view A-A

CIRCULAR CONNECTOR

CROSS-REFERENCE TO RELATED APPLICATIONS

This non-provisional application claims priority under 35 U.S.C. § 119(a) on Patent Application No(s). 109137215 filed in Taiwan, R.O.C. on Oct. 23, 2020, the entire contents of which are hereby incorporated by reference.

BACKGROUND

Technical Field

The present disclosure relates to the technical field of connectors. More particularly, the present disclosure relates to a circular connector with the feature of non-directional electrical connections.

Description of Related Art

In general, a conventional connector includes a male head and a female seat, and the male head is combined with the female seat to achieve the effect of transmitting power and signals.

To achieve the aforementioned effect, the combination is usually performed within the range of an operator's sight in order to confirm the positions of the male head and the female seat and then use a mechanical design such as a lead angle and an inclined plane of the connector to assist the combination of the male head and the female seat.

However, in the application of some electronic products, it is uneasy to achieve the electrical connection simply by watching the condition of the male head and/or the female seat, that is, the conventional connector does not have the so-called "blind insertion" function to be inserted between the male head and the female seat. In particular, the conventional connector is usually directional, and if the connector is inserted rashly in a wrong direction, it may damage the male head and the female seat, or even may cause damages to the back-end electronic product.

Although the conventional connector may come with a fool-proof design to prevent incorrect insertions, it is still very easy to damage the aforementioned structure due to an excessive force applied in the incorrect insertion, particularly when the connector is miniaturized.

In view of the aforementioned drawbacks of the conventional connector, this disclosure provides a circular connector to overcome the drawbacks of the prior art.

SUMMARY

Therefore, it is a first objective of the present disclosure to provide a circular connector having a male head and a female seat with a blind insertion function for non-directional connections.

A second objective of the present disclosure is based on the aforementioned circular connector to provide a circular structure for the male head and the female seat separately, and each circular structure provides a corresponding electrode group, and the combined circular structures allow the electrode group to achieve the effect of transmitting at least one of the power and control signal between the male head and the female seat.

A third objective of the present disclosure is based on the aforementioned circular connector to adjust and design the quantity of electrode groups of the circular structures according to actual product application requirements.

A further objective of the present disclosure is based on the aforementioned circular connector to provide a design that allows the electrode group of each of the circular structures to have independent modes for transmitting the power and/or transmitting the control signals.

A fifth objective of the present disclosure is based on the aforementioned circular connector to provide a design that allows the electrodes of an electrode group of the circular structure to have a mixed mode for transmitting the power and the control signals simultaneously.

A sixth objective of the present disclosure is based on the aforementioned circular connector to provide a design having a same or different quantity of electrodes in the electrode group of each circular structure, and the installation positions of the electrode groups between the circular structures can be designed with a symmetrical or asymmetrical configuration.

A seventh objective of the present disclosure is based on the aforementioned circular connector to provide a design having an equal or unequal distance between the electrodes of each electrode group.

An eighth objective of the present disclosure is based on the aforementioned circular connector to provide a design of an electrode group with a floating structure in the circular structure, so as to achieve an effective blind insertion of the male head with the female seat.

A ninth objective of the present disclosure is based on the aforementioned circular connector to provide a design of a plurality of circular structures and a method of covering small-size circular structures by large-size circular structures, such as the concentric architecture.

A tenth objective of the present disclosure is based on the aforementioned circular connector to provide a male head having a first circular body, a third circular body, a first electrode group and a third electrode group.

An eleventh objective of the present disclosure is based on the aforementioned circular connector to a female seat having a first base, a second circular body, a fourth circular body, a second base, a second electrode group and a fourth electrode group.

A twelfth objective of the present disclosure is based on the aforementioned circular connector to apply the circular connector in the fields of display devices, motor vehicles, or any other devices requiring an electrical connection.

To achieve the foregoing and other objectives, the present disclosure discloses a circular connector applied to a first circuit board and a second circuit board. The circular connector comprises a male head and a female seat. The male head can be coupled to the first circuit board. The male head comprises a first circular body, a third circular body, a first electrode group and a third electrode group. The third circular body is stacked on first circular body. A first slot is formed at the inner periphery of the first circular body for installing a first terminal of the first electrode group. A third slot is formed at the inner periphery of the third circular body for installing a second terminal of the first electrode group. A fifth slot is formed at the outer periphery of the first circular body for installing a first terminal of the third electrode group. A seventh slot is formed at the outer periphery of the third circular body for installing a second terminal of the third electrode group. The female seat can be coupled to the second circuit board. The female seat comprises a first base, a second circular body, a fourth circular body, a second base, a second electrode group and a fourth electrode group. The second base, the fourth circular body, the second circular body and the first base are sequentially arranged from a center point of the female seat towards the outside. A second electrode group is disposed between the first base and the second circular body, and a fourth electrode group is disposed between the fourth circular body and the second base. In addition, a second slot is formed on the second circular body for installing the first terminal of the second electrode group, and a fourth slot is formed on the fourth circular body for installing a first terminal of the fourth electrode group. Wherein, the second slot is configured to be corresponsive to the seventh slot and the fourth slot is configured to be corresponsive to the third slot, and at least one of the second electrode group and the fourth electrode group has a floating structure. Wherein, after the male head is combined with the female seat, the third circular body is inserted between the second circular body and the fourth circular body, so that the second terminal of the third electrode group is electrically coupled to the first terminal of the second electrode group, and the second terminal of the first electrode group is electrically coupled to the first terminal of the fourth electrode group.

To achieve the foregoing and other objectives, the present disclosure discloses a male head of a circular connector, and the male head comprises a first circular body, a third circular body, a first electrode group and a third electrode group. A first slot is formed at the inner periphery of the first circular body and a fifth slot formed at the outer periphery of the first circular body. The third circular body is stacked on the first circular body. The third circular body has a third slot and a seventh slot formed at the inner periphery of the third circular body. The first terminal of the first electrode group is installed into the first slot and the second terminal of the first electrode group is installed into the third slot. The first terminal of the third electrode group is installed into the fifth slot and the second terminal of the third electrode group is installed into the seventh slot.

To achieve the foregoing and other objectives, the present disclosure discloses a female seat of a circular connector, the female seat comprises a first base, a second circular body, a fourth circular body, a second base, a second electrode group and a fourth electrode group. The second circular body is disposed in the first base. A second slot is formed on the second circular body. The fourth circular body is disposed in the second circular body. A fourth slot is formed on the fourth circular body. The second base is disposed in the fourth circular body. The second electrode group is disposed between the first base and the second circular body, and the first terminal of the second electrode group is installed into the second slot. Wherein, the second electrode group has a floating structure. The fourth electrode group is disposed between the fourth circular body and the second base, and the first terminal of the fourth electrode group is installed into the fourth slot. Wherein, the fourth electrode group has a floating structure. Wherein, the second base, the fourth circular body, the second circular body and the first base are sequentially arranged from a center point of the female seat towards the outside.

Compared with the prior art, the present disclosure provides a circular connector with the effect of non-directional connections that provides extreme convenience for users and/or operators. For designers, hundreds of terminals (which are called electrodes in the specification of this disclosure) are installed in a limited space, and the present disclosure provides a circular connector with a design of transmitting power and control signals simultaneously as well as a design of transmitting the power and control signals independently, so that the designers can offer more complicated and high-end applications to users by means of the design of more terminals and simultaneous and independent transmissions of the terminals.

BRIEF DESCRIPTION OF THE DRAWINGS

FIG. 7(*b*) is a cross-sectional view of the Section A-A of a male head before being combined with a female seat in accordance with the present disclosure;

DESCRIPTION OF THE EMBODIMENTS

The accompanying drawings are included to provide a further understanding of the disclosure, and are incorporated in and constitute a part of this specification. The drawings illustrate embodiments of the disclosure and, together with the description, serve to explain the principles of the disclosure.

Figure 1:
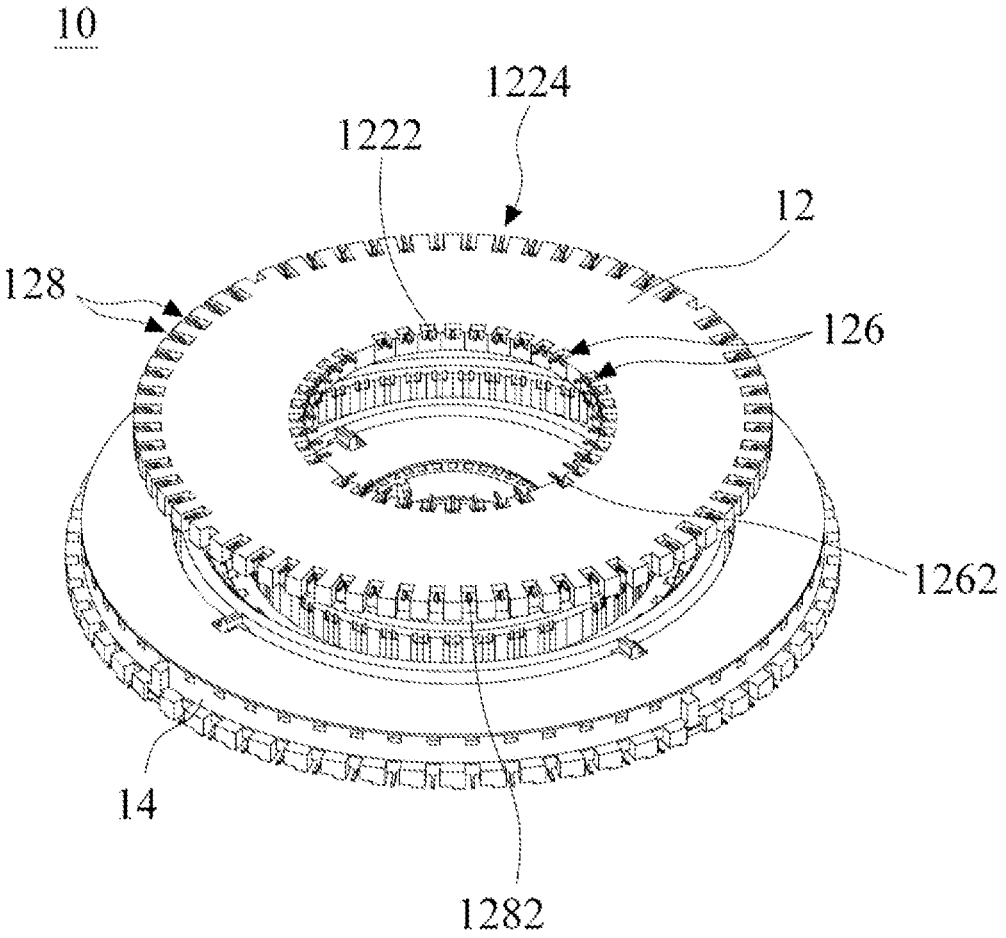
FIG. 1 is a schematic view of a circular connector in accordance with an embodiment of this disclosure.
Figure 10:
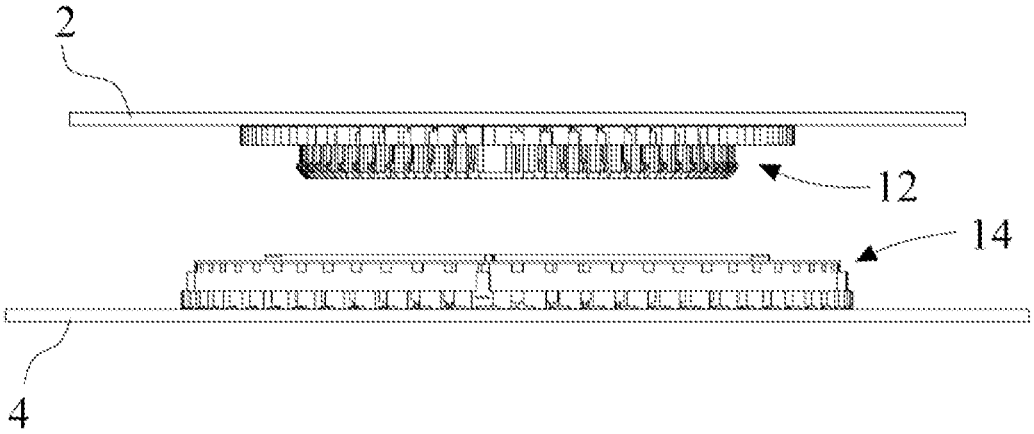
FIG. 10 is a side view showing the connection of a circular connector of the present disclosure as depicted in FIG. 1.

With reference to FIG. 1 for the schematic view of a circular connector in accordance with an embodiment of the present disclosure, the circular connector 10 is applied to a first circuit board 2 and a second circuit board 4. With reference to FIG. 10 for the side view showing the connection of the circular connector 10 with the first circuit board 2 and the second circuit board 4. In this embodiment, the first circuit board 2 is a part of a display panel (not shown in the figure) and the second circuit board 4 is a frame of a wall (not shown in the figure), and a male head 12 disposed on the first circuit board 2 is combined with a female seat 14 disposed on the second circuit board 4, so that the display panel can receive control signals and power signals from the female seat 14 through the male head 12 of the first circuit board 2.

Figure 2:
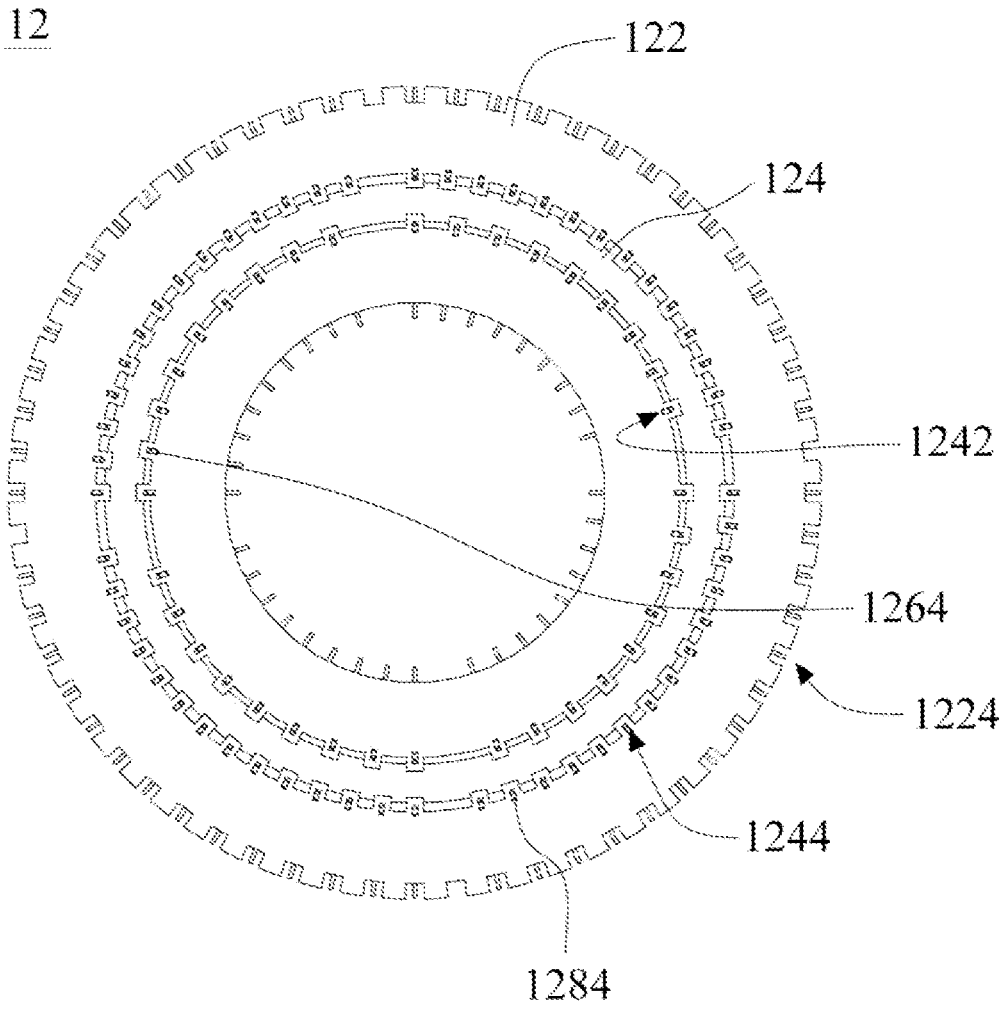
FIG. 2 is a bottom view of a male head as depicted in FIG. 1.

In FIG. 1, the circular connector 10 comprises a male head 12 and a female seat 14. Besides the female seat 14, the male head 12 provides a first slot 1222, a fifth slot 1224, a first electrode group 126, a first terminal 1262 of the first electrode group 126, a third electrode group 128 and a first terminal 1282 of the third electrode group 128. In this embodiment, the circular connector 10 is a circular ring; and in other embodiments, the circular connector 10 can be a circular body such as a rectangular ring, an even-sided polygonal ring, or an odd-sided polygonal ring. Refer to FIG. 2 for the detailed illustration of the male head 12 and FIGS. 3 to 6 for that of the female seat 14.

With reference to FIG. 2 for the bottom view of a male head as depicted in FIG. 1 of the present disclosure, the male head 12 provides a first circular body 122, a third circular body 124, a second terminal 1264 of the first electrode group 126 and a second terminal 1284 of the third electrode group 128, a third slot 1242, a fifth slot 1224 and a seventh slot 1244.

Figure 7A:
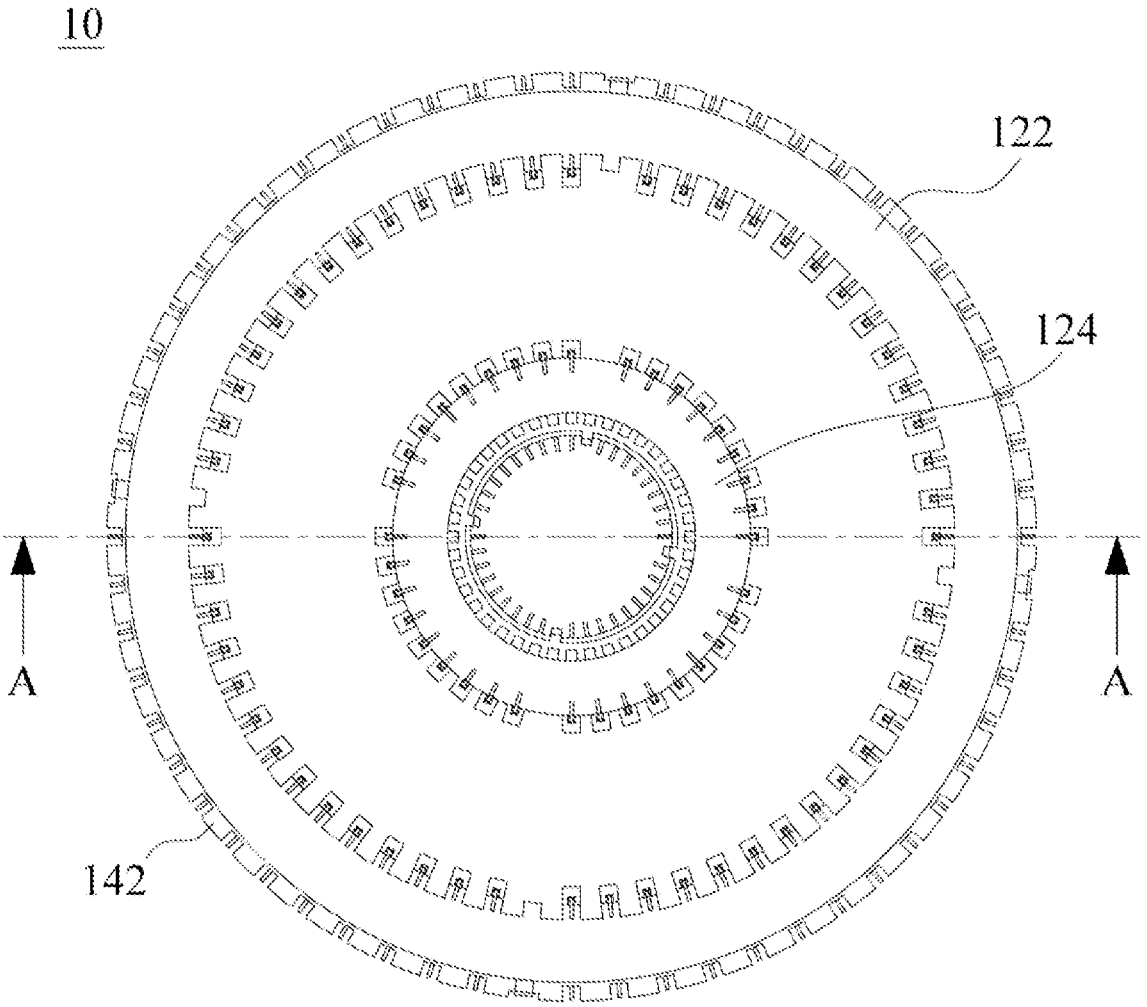
FIG. 7(*a*) is a top view of a male head before being combined with a female seat in accordance with the present disclosure.
Figure 7B:
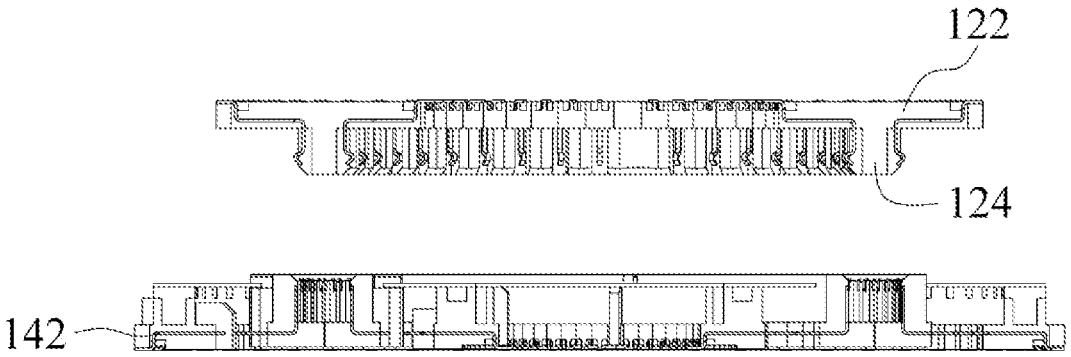

Both of the first circular body 122 and the third circular body 124 are circular rings, and the diameter of the first circular body 122 is greater than the diameter of the third circular body 124. In this embodiment, the third circular body 124 is stacked on the first circular body 122, so that the third circular body 124 protrudes from the first circular body 122 (as shown in FIG. 7 which is a schematic view showing that the first circular body 122 is combined with the third circular body 124).

Back to FIG. 2, a fifth slot 1224 is formed at the outer periphery of the first circular body 122 for installing the first terminal 1282 of the third electrode group 128 as shown in FIG. 1. Wherein, the first terminal 1282 of the third electrode group 128 is soldered on the first circuit board 2 and provided for receiving a control signal and/or a power signal (not shown in the figure) from the first circuit board 2. In addition, the second terminal 1284 of the third electrode group 128 is passed through the first circular body 122 as shown in FIG. 2 and exposed from the seventh slot 1244 of the third circular body 124. The first slot 1222A is formed at the inner periphery of the first circular body 122 and provided for installing the first terminal 1262 of the first electrode group 126 as shown in FIG. 1. The first terminal 1262 of the first electrode group 126 is soldered on the first circuit board 2 and provided for receiving a control signal and/or a power signal (not shown in the figure) from the first circuit board 2.

In addition to the aforementioned seventh slot 1244 formed at the outer periphery of the third circular body 124, the third slot 1242 is formed at the inner periphery of the third circular body 124 and provided for installing the second terminal 1264 of the first electrode group 126.

Wherein, the quantity of fifth slots 1224 and seventh slots 1244 is greater than or equal to the quantity of third electrode groups 128; and the quantity of first slots 1222 and third slots 1242 is greater than or equal to the quantity of first electrode groups 126.

Figure 3:
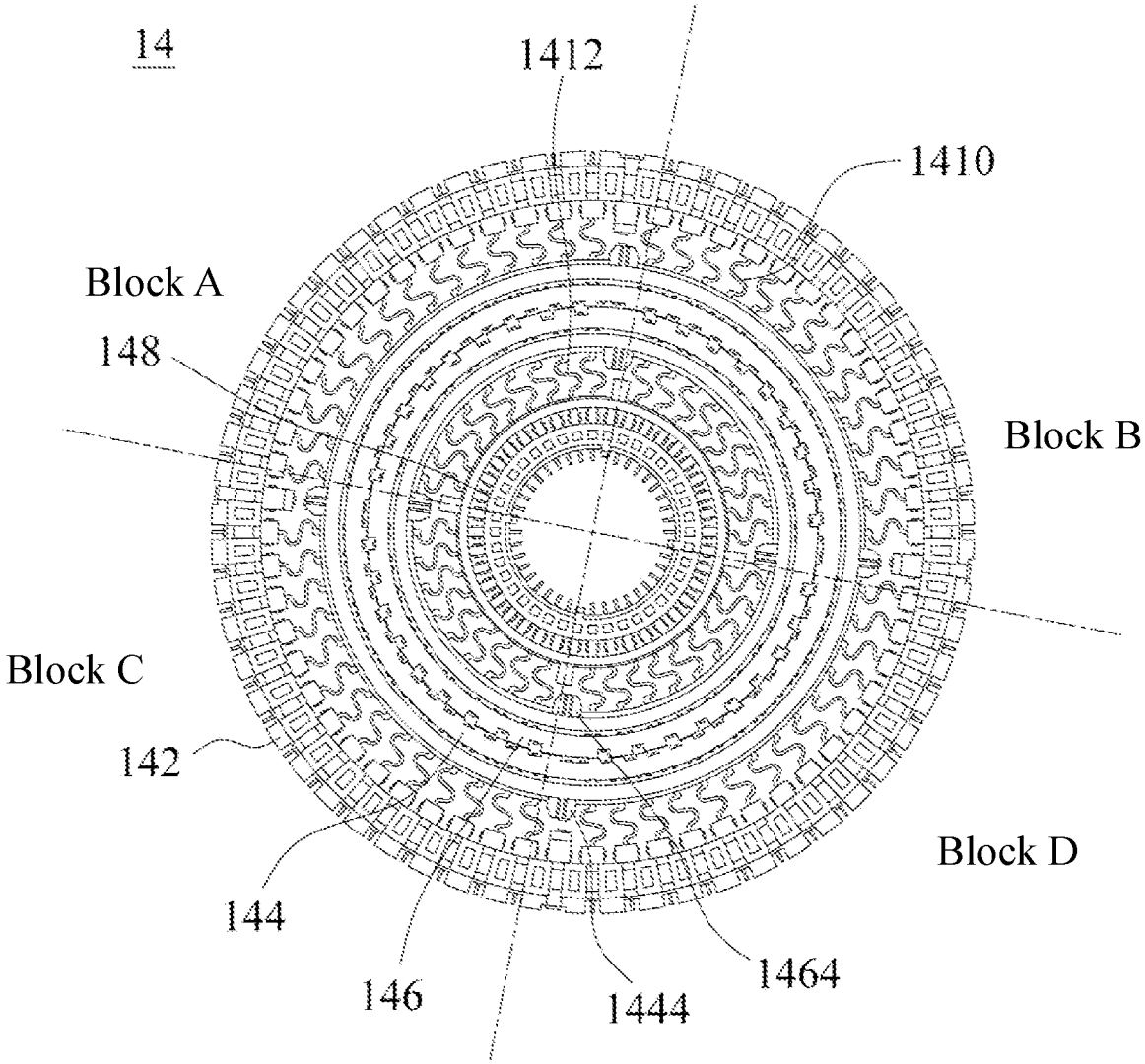
FIG. 3 is a top view of a female seat as depicted in FIG. 1.

With reference to FIG. 3 for a female seat of the present disclosure as depicted in FIG. 1, the female seat 14 provides a first base 142, a second circular body 144, a fourth circular body 146, a second base 148, a second electrode group 1410 and a fourth electrode group 1412. The first base 142 and the second base 148 are fixed on the second circuit board 4. The second base 148, the fourth circular body 146, the second circular body 144 and the first base 142 are arranged sequentially from a center point of the female seat 14 towards the outside.

Figure 4:
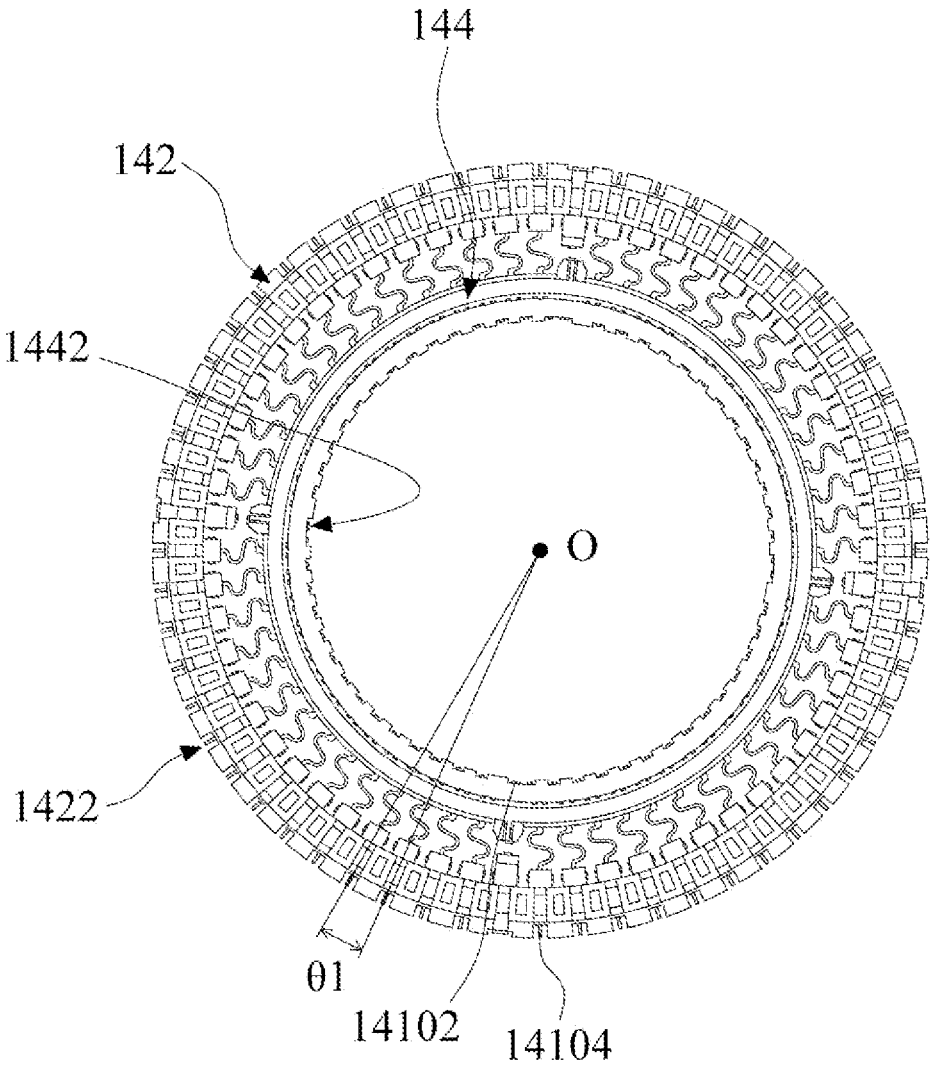
FIG. 4 is a top view of a second circular body and a first base of this disclosure.

With reference to FIG. 4 for the top view of a second circular body and a first base of the present disclosure as depicted in FIG. 3, the first base 142 is made of an electrically insulating material such as plastic. The first base 142 has a plurality of slots 1422 formed at the outer periphery of the first base 142 and configured to be corresponsive to the second slots 1442 of the second circular body 144 for exposing the second terminal 14104 of the second electrode group 1410. The second terminal 14104 of the second electrode group 1410 is soldered on the second circuit board 4 and provided for receiving a control signal and/or a power signal (not shown in the figure) from the second circuit board 4. Wherein, the second electrode group 1410 is disposed between the first base 142 and the second circular body 144. Besides the aforementioned second terminal 14104 exposed from the slots 1422, the second electrode group 1410 further provides a floating structure and a first terminal 14102, and the second electrode group 1410 is made of an electrically conductive material such as metal. Wherein, the floating structure is in a shape similar to the shape of a letter S as shown in FIG. 4 and formed between the first terminal 14102 and the second terminal 14104 of the second electrode group 1410, so that when an external force is acted on the second circular body 144 (or the fourth circular body 146), the deformation of the deformed floating structure changes the offset between the second circular body 144 and the first base 142 and the first terminal 14102 of the second electrode group 1410 is exposed from second slot 1442 for transmitting a control signal and/or a power signal from the second circuit board, and the second slot 1442 is configured to be corresponsive to the seventh slot 1244 as shown in FIG. 2.

In addition, the second electrode group 1410 is composed of a plurality of second electrodes. The range of a minimum angle included between the second electrodes starting from a center point O (which is the center) of the second circular body 144 is related to the solder size of the second terminal 14104 of the second electrode group 1410 soldered on the second circuit board 4. In short, as long as there is no interference or short circuit occurred between the adjacent second terminals 14104 of the second electrode group 1410 during the soldering process, the minimum angle θ1 included between two adjacent second terminals 14104 of the second electrode group 1410 can approach zero degree, and thus the range of the minimum angles θ1 is greater than or equal to 7 degrees.

Figure 5:
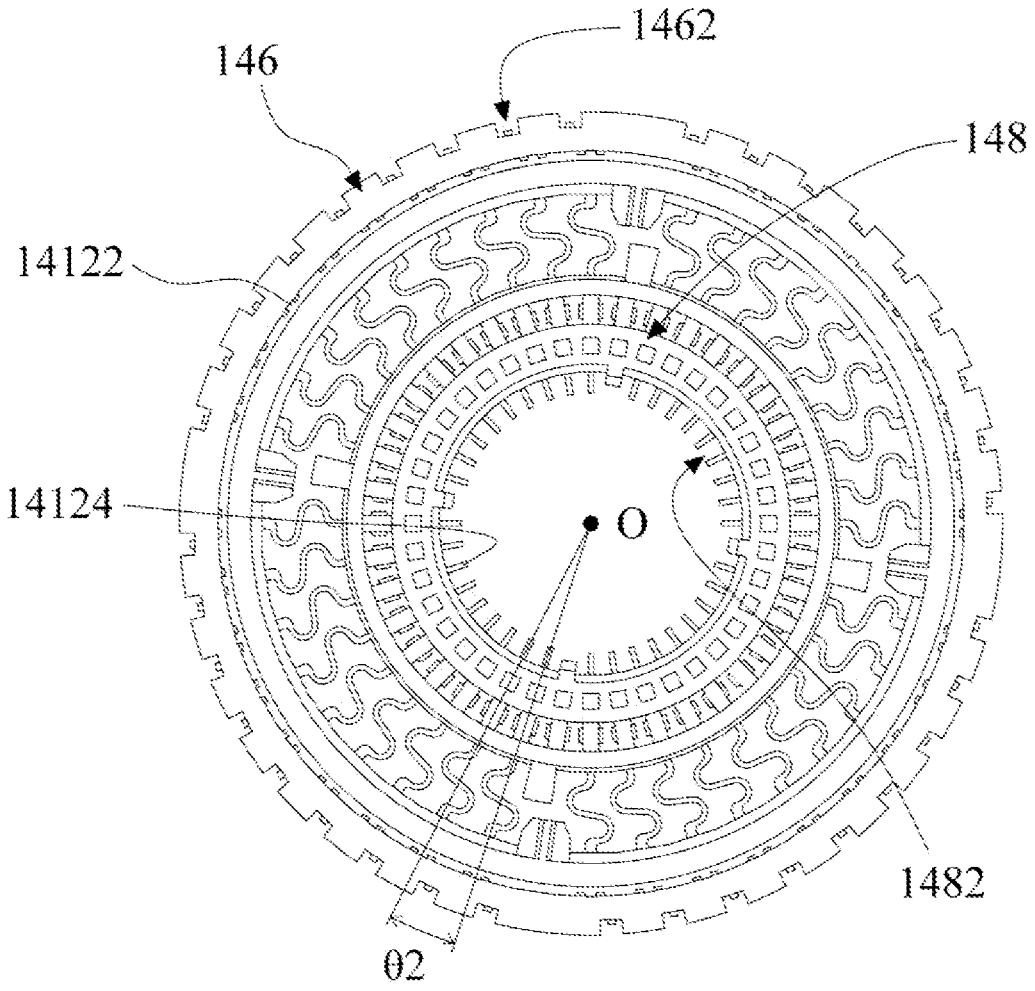
FIG. 5 is a top view of a fourth circular body and a second base of this disclosure.
Figure 8:
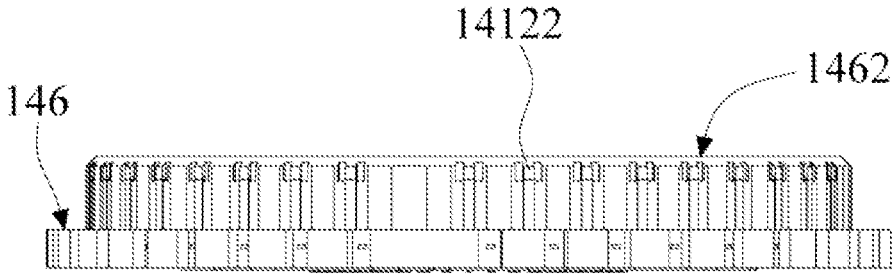
FIG. 8 is a side view of a fourth circular body of the present disclosure as depicted in FIG. 3.
Figure 9:
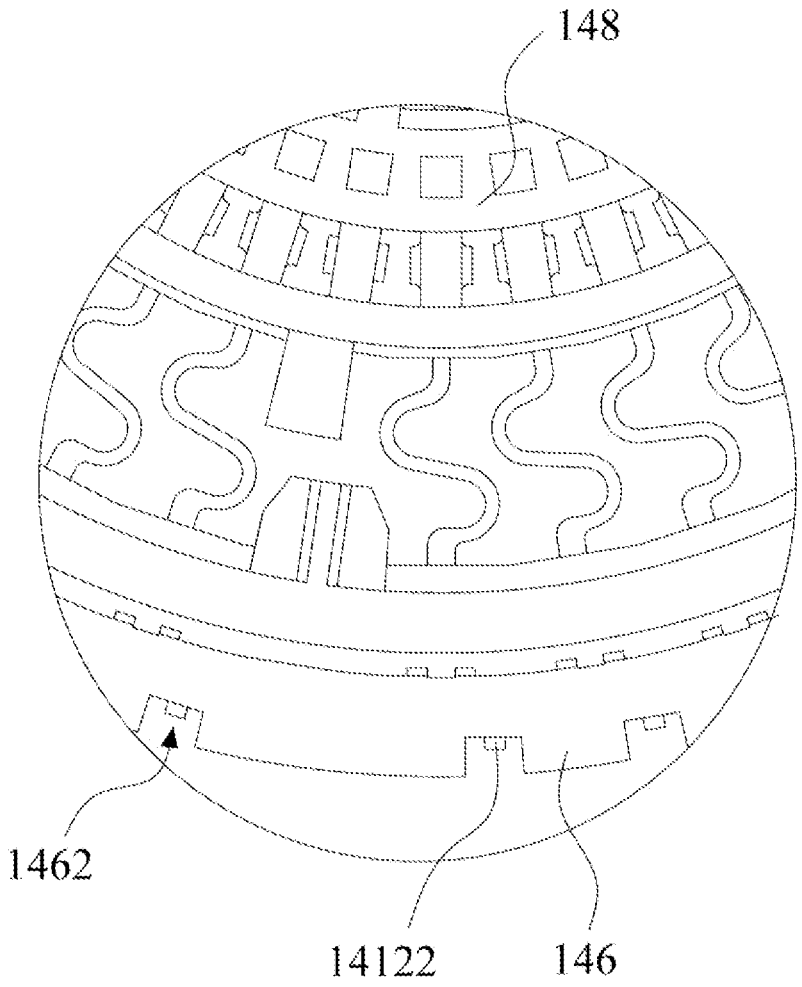
FIG. 9 is a top partial blow-up view of a fourth circular body of the present disclosure as depicted in FIG. 8.

With reference to FIG. 5 for the top view of a fourth circular body and a second base in accordance with the present disclosure as depicted in FIG. 3, the second base 148 is made of an electrically insulated material such as plastic. The second base 148 has a plurality of slots 1482 formed at the inner periphery of the second base 148 and under the second base 148 as shown in FIG. 5, and the slots 1482 are configured to be corresponsive to the fourth slot 1462 of the fourth circular body 146 for exposing the second terminal 14124 of the fourth electrode group 1412. The second terminal 14124 of the fourth electrode group 1412 is soldered on the second circuit board 4 for receiving a control signal and/or a power signal (not shown in the figure) from the second circuit board 4. Wherein, the fourth electrode group 1412 is disposed between the second base 148 and the fourth circular body 146. Besides the aforementioned second terminal 14124 exposed from the slots 1482, the fourth electrode group 1412 furthers provides a floating structure and a first terminal 14122, and the fourth electrode group 1412 is made of an electrically conductive material such as metal. Wherein, the floating structure is in a shape similar to the shape of a letter S as shown in FIG. 5 and formed between the first terminal 14122 and the second terminal 14124 of the fourth electrode group 1412, so that when an external force is acted onto the fourth circular body 146 (or the second circular body 144), the deformation of the floating structure changes the offset between the fourth circular body 146 and the second base 148, and the first terminal 14122 of the fourth electrode group 1412 is exposed from the fourth slot 142 for transmitting a control signal and/or a power signal from the second circuit board 4, and the fourth slot 142 is configured to be corresponsive to the third slot 1242 of the third circular body 124 as shown in FIG. 2. With reference to FIG. 8 altogether for the side view of a fourth circular body in accordance with another embodiment of the present disclosure as depicted in FIG. 3, the fourth slot 1462 is designed with a small plane to facilitate the installation of the first terminal 14122 of the fourth electrode group and the smooth installation of the first terminal 14122 of the fourth electrode group to the fourth slot 1462, and the same design can also be applied to other slots of the present disclosure. With reference to FIG. 9 altogether for the top partial blow-up view of a fourth circular body of the present disclosure as depicted in FIG. 8, the fourth slot 1462 is designed with a small plane and provided for installing the first terminal 14122 of the fourth electrode group.

The fourth electrode group 1412 is composed of a plurality of fourth electrodes. The range of a minimum angle included between the fourth electrodes starting from a center point O (which is the center) of fourth circular body 146 is related to the solder size of the second terminal 14124 of the fourth electrode group 1412 soldered on the second circuit board 4. In short, as long as there is no interference or short circuit occurred between the adjacent second terminals 14124 of the fourth electrode group 1412 during the soldering process, the minimum angle θ2 included between two adjacent second terminals 14124 of the fourth second electrode group 1412 can approach zero degree, and thus the range of the minimum angle θ2 is greater than or equal to the aforementioned range of minimum angles θ1.

The quantity of second electrode groups 1410 of the aforementioned second circular body 144 is greater than or equal to the quantity of fourth electrode groups 1412 of the fourth circular body 146, and the arranged position of the second electrode of the second electrode group 1410 and the arranged position of the fourth electrode of the fourth electrode group 1412 can be symmetrical or asymmetrical. For example, a first bump group 1444 and a second bump group 1464 as shown in FIG. 3 are provided for dividing the circular rings into a plurality of blocks A, B, C, and D, and the quantity of second electrodes of the second electrode group and the quantity of fourth electrodes of the fourth electrode group 1412 in the blocks A, B, C and D are the same in this embodiment. However, in other embodiments, only the symmetrical blocks such as the diagonal blocks (block A and block C) have the arranged positions for the second electrodes and/or the fourth electrodes; and only the asymmetrical blocks such as the adjacent blocks (block A and block B) have the installation positions for the second electrodes and/or the fourth electrodes.

Besides the quantity and the installation position, the first electrode group 126 and the third electrode 128 provide an independent mode of transmitting the power signal and control signal to each other, and the second electrode group 1410 and the fourth electrode 1412 provide an independent mode of transmitting the power signal and control signal to each other, and the first electrode group 126 or the third electrode group 128 provides a mixed mode of transmitting the power signal and control signal simultaneously, and the second electrode group 1410 or the fourth electrode group 1412 provides a mixed mode of transmitting the power signal and control signal simultaneously.

Figure 6:
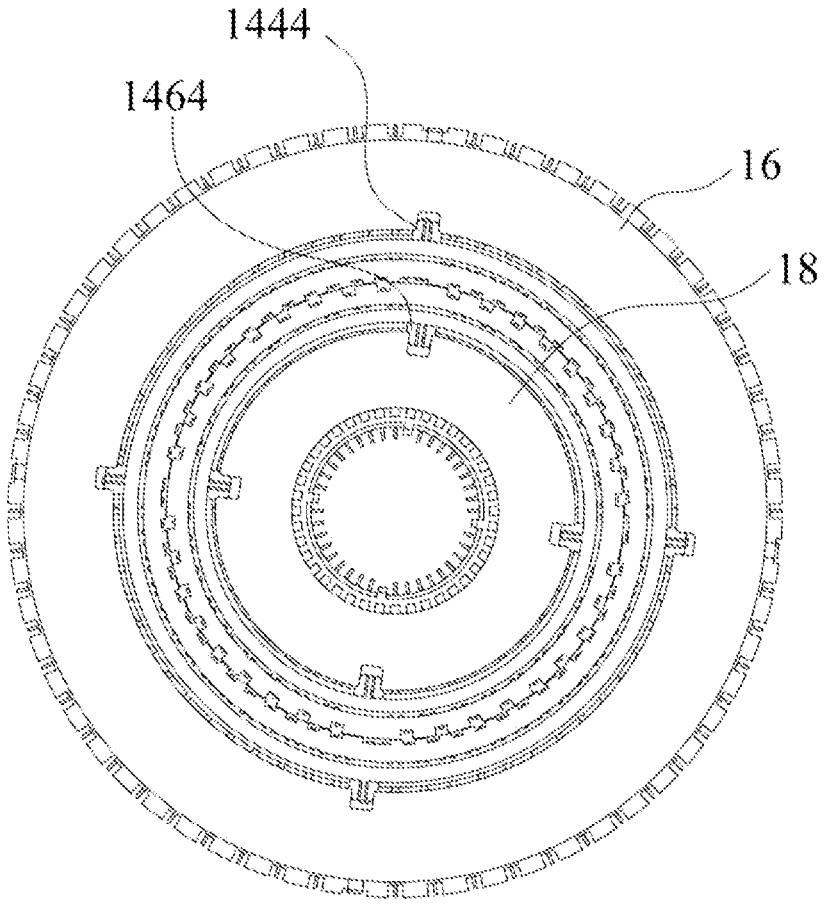
FIG. 6 is a schematic view of a female seat in accordance with another embodiment of the present disclosure as depicted in FIG. 3.

With reference to FIG. 6 for the schematic view of a female seat in accordance with another embodiment as depicted in FIG. 3, the female seat 14 further comprises a first cover 16, a second cover 18, a first bump group 1444 and a second bump group 1464 in addition to the first base 142, the second circular body 144, the fourth circular body 146, the second base 148, the second electrode group 1410 and the fourth electrode group 1412 as described in the previous embodiment.

The description of the first base 142, the second circular body 144, the fourth circular body 146, the second base 148, the second electrode group 1410 and the fourth electrode group 1412 is the same as the description above, and thus will not be repeated.

The first cover 16 is provided for covering the floating structure of the second electrode group 1410.

The second cover 18 is provided for covering the floating structure of the fourth electrode group 1412.

The first bump group is disposed at the outer periphery of the second circular body 144 for installing and positioning the first cover 16.

The second bump group 1464 is installed at the inner periphery of the fourth circular body 146 for installing and positioning the second cover 18.

With reference to FIGS. 7(*a*) and 7(*b*) for the schematic view of a male head and a female seat before they are combined in accordance with the present disclosure as depicted in FIG. 1, FIG. 7(*a*) is the top view showing the male head before being combined with the female seat of the present disclosure as depicted in FIG. 1 and FIG. 7(*b*) is a side view of Section A-A of the male head before being combined with the female seat of the present disclosure. FIGS. 7(*a*) and 7(*b*) can assist the description of the aforementioned embodiment. When the male head 12 is combined with the female seat 14, the third circular body 124 is inserted between the second circular body 144 and the fourth circular body 146, so that the second terminal 1284 of the third electrode group 128 is electrically coupled to the first terminal 14102 of the second electrode group 1410 and the second terminal 1264 of the first electrode group 126 is electrically coupled to the first terminal 14102 of the fourth electrode group 1412.

What is claimed is:

1. A circular connector, applied to a first circuit board and a second circuit board, and the circular connector comprising:

a male head, for coupling the first circuit board, and the male head having a first circular body, a third circular body, a first electrode group and a third electrode group, and the third circular body being stacked on the first circular body, and a first slot being formed at the inner periphery of the first circular body for installing a first terminal of the first electrode group, and a third slot being formed at the inner periphery of the third circular body for installing a second terminal of the first electrode group, and a fifth slot being formed at the outer periphery of the first circular body for installing a first terminal of the third electrode group, a seventh slot being formed at the outer periphery of the third circular body for installing a second terminal of the third electrode group; and a female seat, for coupling the second circuit board, and the female seat having a first base, a second circular body, a fourth circular body, a second base, a second electrode group and a fourth electrode group, and the second base, the fourth circular body, the second circular body and the first base being arranged sequentially from the center point of the female seat to the outside, and the second electrode group being disposed between the first base and the second circular body, and the fourth electrode group being disposed between the fourth circular body and the second base, and the second circular body having a second slot formed thereon for installing a first terminal of the second electrode group, and the fourth circular body having a fourth slot formed thereon for installing a first terminal of the fourth electrode group, wherein the second slot is configured to be corresponsive to the seventh slot and the fourth slot is configured to be corresponsive to the third slot, and at least one of the second electrode group and the fourth electrode group has a floating structure;

wherein, the male head is combined with the female seat, and the third circular body is inserted between the second circular body and the fourth circular body, so that the second terminal of the third electrode group is electrically coupled to the first terminal of the second electrode group and the second terminal of the first electrode group are electrically coupled to the first terminal of the fourth electrode group.

2. The circular connector as claimed in claim 1, wherein the floating structure is formed between the first terminal and the second terminal of the second electrode group, and the floating structure is also formed between the first terminal and the second terminal fourth electrode group, and the floating structures are in the shape similar to that of the letter S.

3. The circular connector as claimed in claim 1, wherein the second electrode group is composed of a plurality of second electrodes, and the range of a minimum angle included between the second electrodes starting from the centre point of the second circular body is related to a solder size of the second terminal of the second electrode group soldered the second circuit board.

4. The circular connector as claimed in claim 1, wherein the fourth electrode group is composed of a plurality of fourth electrodes, and the range of a minimum angle included between the fourth electrodes starting from a centre point of the fourth circular body is related to a solder size of the second terminal of the fourth electrode group soldered to the second circuit board.

5. The circular connector as claimed in claim 1, wherein the quantity of second electrode groups of the second circular body is not smaller than the quantity of fourth electrode groups of the fourth circular body, and the arranged position of the second electrodes and the arranged position of the fourth electrodes are symmetrical or asymmetrical to each other.

6. The circular connector as claimed in claim 1, wherein the first electrode group and the third electrode group provide an independent mode of transmitting a power signal and a control signal to each other, and the second electrode group and the fourth electrode group provide an independent mode of transmitting the power signal and the control signal to each other.

7. The circular connector as claimed in claim 1, wherein the first electrode group or the third electrode group provides a mixed mode of transmitting a power signal and a control signal simultaneously, and the second electrode group or the fourth electrode group provides a mixed mode of transmitting the power signal and the control signal simultaneously.

8. The circular connector as claimed in claim 1, wherein the first electrode group, the third electrode group, the second electrode group and the fourth electrode group are provided for transmitting a power signal or a control signal.

9. A male head of a circular connector, comprising:

a first circular body, having a first slot formed at the inner periphery of the first circular body and a fifth slot formed at the outer periphery of the first circular body;

a third circular body, stacked on the first circular body, and having a third slot and a seventh slot formed at the inner periphery of the third circular body;

a first electrode group, having a first terminal installed into the first slot and a second terminal installed into the third slot; and a third electrode group, having a first terminal installed into the fifth slot and a second terminal installed into the seventh slot.

10. A female seat of a circular connector, comprising:

a first base;

a second circular body, disposed in the first base, and having a second slot formed on the second circular body;

a fourth circular body, disposed in the second circular body, and having a fourth slot formed on the fourth circular body;

a second base, disposed in the fourth circular body;

a second electrode group, disposed between the first base and the second circular body, and the first terminal of the second electrode group being installed into the second slot, wherein the second electrode group has a floating structure; and a fourth electrode group, disposed between the fourth circular body and the second base, and the first terminal of the fourth electrode group being installed into the fourth slot, wherein the fourth electrode group has the floating structure; and the second base, the fourth circular body, the second circular body and the first base are arranged sequentially from a centre point of the female seat towards the outside.

* * * * *